US005921398A

United States Patent [19]

Carroll

[11] Patent Number: 5,921,398

[45] Date of Patent: Jul. 13, 1999

[54] STORAGE AND DISPLAY CARTON

[75] Inventor: Michael F. Carroll, Cincinnati, Ohio

[73] Assignee: Star-Kist Foods, Inc., Newport, Ky.

[21] Appl. No.: 09/005,585

[22] Filed: Jan. 12, 1998

[51] Int. Cl.[6] ..... B65D 5/50

[52] U.S. Cl. ..... 206/736; 206/746; 229/235

[58] Field of Search ..... 206/192, 736, 206/746, 747; 229/235

[56] References Cited

U.S. PATENT DOCUMENTS

| | | | |
|---|---|---|---|
| 776,042 | 11/1904 | Acheson . | |
| 2,020,876 | 11/1935 | Clark et al. | 206/747 |
| 2,131,391 | 9/1938 | Schraffenberger . | |
| 3,090,483 | 5/1963 | Altree et al. | 229/235 |
| 3,280,968 | 10/1966 | Craine . | |
| 3,653,495 | 4/1972 | Gray . | |
| 3,884,348 | 5/1975 | Ross . | |
| 4,467,923 | 8/1984 | Dornbusch et al. | 206/192 |
| 4,905,837 | 3/1990 | Schuster et al. . | |
| 5,152,079 | 10/1992 | Mott . | |
| 5,181,650 | 1/1993 | Hollander et al. . | |

FOREIGN PATENT DOCUMENTS

| | | |
|---|---|---|
| 0726205 | 8/1996 | European Pat. Off. . |
| 2669893-A1 | 6/1992 | France . |

*Primary Examiner*—David T. Fidel

*Attorney, Agent, or Firm*—Burns Doane Swecker & Mathis, L.L.P.

[57] ABSTRACT

A shipping and display container has two opposing end panels in a spaced parallel relationship and front and rear panels in a spaced parallel relationship defining opposing front and rear container surfaces. The front and rear panels are connected to the two opposing end panels to form a container periphery. A bottom panel extends within the container periphery to define a bottom surface of the container. A top panel also extends within the container periphery to define a top surface of the container. The top surface includes an opening for viewing the contents of the container. The container is also convertible from a storage configuration to a display configuration. The conversion mechanism includes the top surface and the front surface having a removable portion defined by a pattern of lines of weakening, at least the top surface and the rear surface including a further line of weakening, and the bottom surface defining a fold line. Thus, after removal of the removable portion, the line of weakening in the top surface is torn and opposing ends of the container are rotated about the fold line in the bottom surface. In so doing, side-by-side displays may be obtained.

15 Claims, 4 Drawing Sheets

STORAGE AND DISPLAY CARTON

BACKGROUND OF THE INVENTION

1. Field of the Invention

The present invention relates generally to a carton for the storage, transport and display of a packaged product, and more particularly, to a carton which is convertible from a substantially sealed configuration for storage and transport of a packaged product to a substantially open configuration for display of a packaged product.

2. Description of the Related Art

Cartons, and in particular paperboard cartons or boxes, have been used for many years to store and transport various products. Products have generally been packed within a paperboard box which is provided with a removable lid or integral folded top which is sealed. The boxes are transported within the sealed boxes from the manufacturing facility to the place of retail sale. In order to present the products for retail sale, store personnel must open the folded top of the sealed box or completely remove the lid, remove each individual package from the box, properly position the packages on available display shelves, and then discard the storage box. Thus, transporting a packaged product from a storage location to a display location using conventional paperboard boxes was a labor intensive process. The sealed boxes, unless labeled or printed externally, also prevented retailers from determining what was packaged therewithin. In addition, discard of the paperboard box after the product had been placed on display for retail sale created considerable waste for the retailer, in addition to raising environmental concerns.

The use of stand-up resealable pouches, being generally rectangular with a generally triangular cross-sectional shape, has also complicated the efficient packing of products packaged therein. Various forms of chipboard trays may be loaded with the stand-up packages and then placed within a further corrugated shipping container. This arrangement, however, due to the irregular shape of the packages, resulted in larger shipping containers which increased the cost for manufacturing since more material was required.

To reduce the costs and labor requirements associated with conventional cases used to transport stand up packages, shipping and display containers such as those disclosed in U.S. Pat. No. 3,653,495 to Gray have also been utilized. The Gray container allows the irregularly shaped stand up type packages to be nested or interleaved during shipping. The patent further discloses that the container has weakened portions on the ends and tops such that the container can be severed into two halves which were connected at the bottom. The two halves can then be rotated to form two abutting back-to-back display trays. The Grey container, however, like the sealed boxes before, completely sealed the container and prevented the retailer from determining the contents thereof without opening the container. In addition, the Gray container is a modified regular slotted container requiring sealing of both the bottom surface and the top of the container.

Accordingly, there exists a need for a shipping and storage carton or container which may easily be converted into a display device and which enables the retailer to view the packaged product within the sealed carton when in the storage configuration, and which is easily fabricated.

SUMMARY OF THE INVENTION

The present invention overcomes this disadvantage of the prior art, as well as others by providing a means for visually inspecting the orientation of the contents of the container without opening the same. The shipping and display container of the present invention includes two opposing end panels in a spaced parallel relationship and front and rear panels in a spaced parallel relationship defining opposing front and rear container surfaces. The front and rear panels are connected to the two opposing end panels to form a container periphery. A bottom panel extends within the container periphery to define a bottom surface of the container. A top panel also extends within the container periphery to define a top surface of the container. The top surface includes an opening for viewing the contents of the container and the orientation thereof. The container is also convertible from a storage configuration to a display configuration. The conversion means includes the top surface and the front surface having a removable portion defined by a pattern of lines of weakening, at least the top surface and the rear surface including a further line of weakening, and the bottom surface defining a fold line. Thus, after removal of the removable portion, the line of weakening in the top surface is separated or torn and opposing ends of the container are rotated about the fold line in the bottom surface. In so doing, the line of weakening in the rear surface is also separated or torn and side-by-side displays are obtained with the packaged product in an upright orientation.

BRIEF DESCRIPTION OF THE DRAWINGS

Many objects, features and advantages of the present invention will become more readily apparent to those skilled in the art upon reading the following detailed description, in conjunction with the appended drawings, in which.

DETAILED DESCRIPTION OF THE PREFERRED EMBODIMENTS

Figure 1:
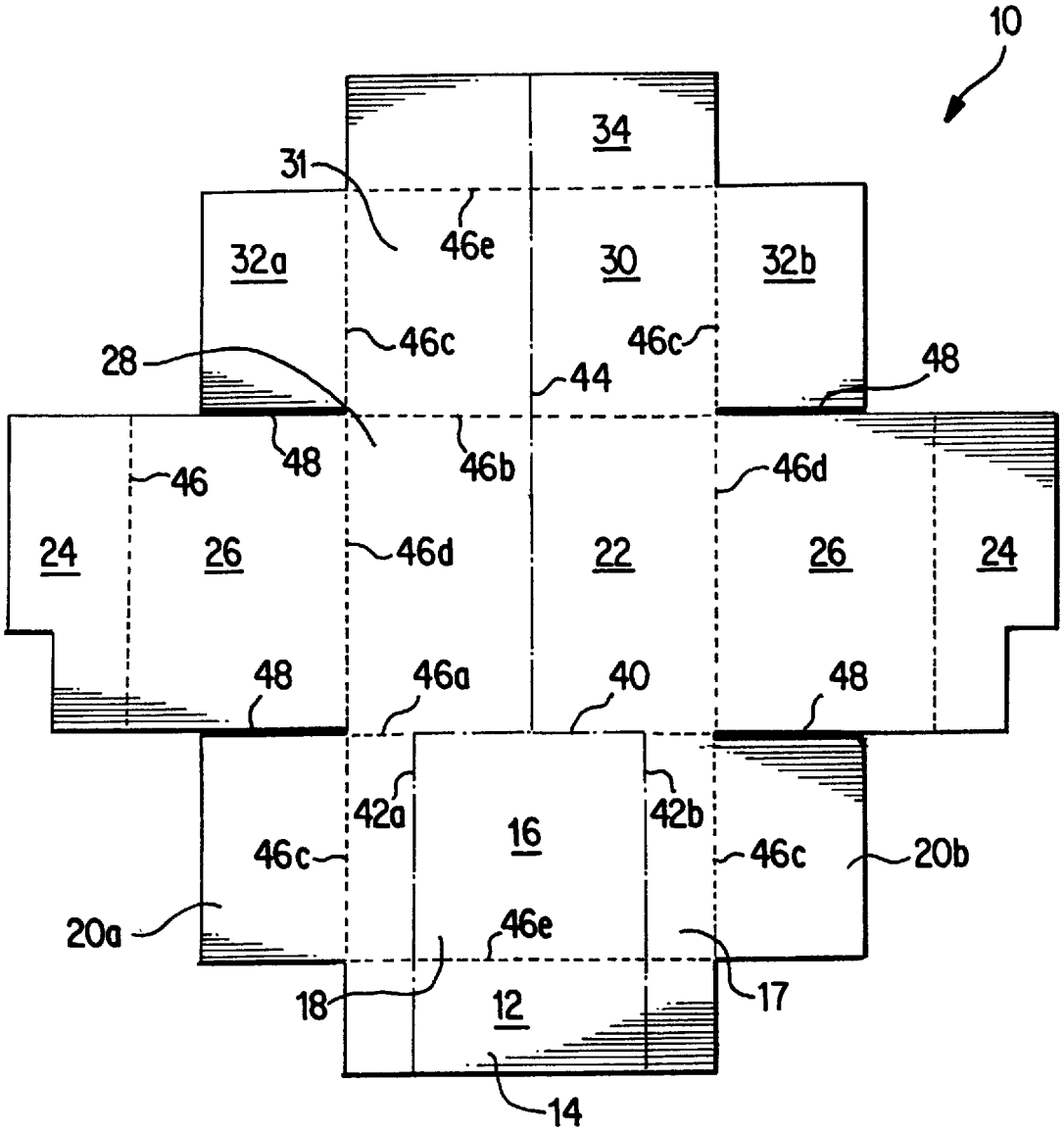
FIG. 1 is a plan view of a blank for forming the carton of the present invention.

Referring to FIG. 1, a foldable blank for forming a storage and display carton in accordance with the present invention is generally shown by reference numeral 10. Blank 10 is preferably formed from paperboard, such as corrugated cardboard, although it is also within the scope of the present invention to use single ply material depending upon the weight of the packaged products to be loaded. Blank 10 is preferably die cut from a sheet of material, the solid lines in FIG. 1 representing cutting lines. Blank 10 is formed with a front top flap 12, a front portion 16, a center portion 22, a rear portion 30 and a rear top flap 34. Blank 10 also includes a plurality of lines of weakening 46 which define fold lines for forming the carton. Lines of weakening 46 are shown in FIG. 1 by dotted lines and are preferably formed as scored lines in the paperboard material.

The front top flap 12 is generally rectangular, in the illustrated embodiment, and includes a middle removable portion 14. The front portion 16 is also generally rectangular, includes a foldable side flap 20*a,* 20*b* on each end thereof and a middle removable portion 18. The front portion 16 is perforated along line 40 and front portion 16 and front top flap 12 include lines or weakening 42*a,* 42*b* to thereby define middle removable portions 14, 18, respectively, as will be discussed more fully below. The lines of weakening 42*a,* 42*b* are formed as perforated lines in the embodiment of FIG. 1 and are represented by the dot-dash lines as illustrated in FIG. 1. Although perforation lines 42*a,* 42*b* are preferably parallel to one another, as in the illustrated embodiment, it is within the scope of the present invention to also have non-parallel lines defining the removable portions 14, 18.

Center portion 22 includes a center bottom panel member 28, opposing end panels 26 disposed adjacent thereto, and top cut out flaps 24 on each end. Rear portion 30 is generally rectangular, in the illustrated embodiment, and includes foldable side flaps 32*a,* 32*b.* A rear top flap 34 extends from a top edge of the rear portion 30. A further line of weakening 44, which may be formed as perforations, bisects the center portion 22, rear portion 32 and rear top flap 34 to thereby define two bases for display of the packaged product in a display configuration, as will be further explained below. Perforated line 44 preferably extends perpendicular to perforated line 40.

Figure 6:
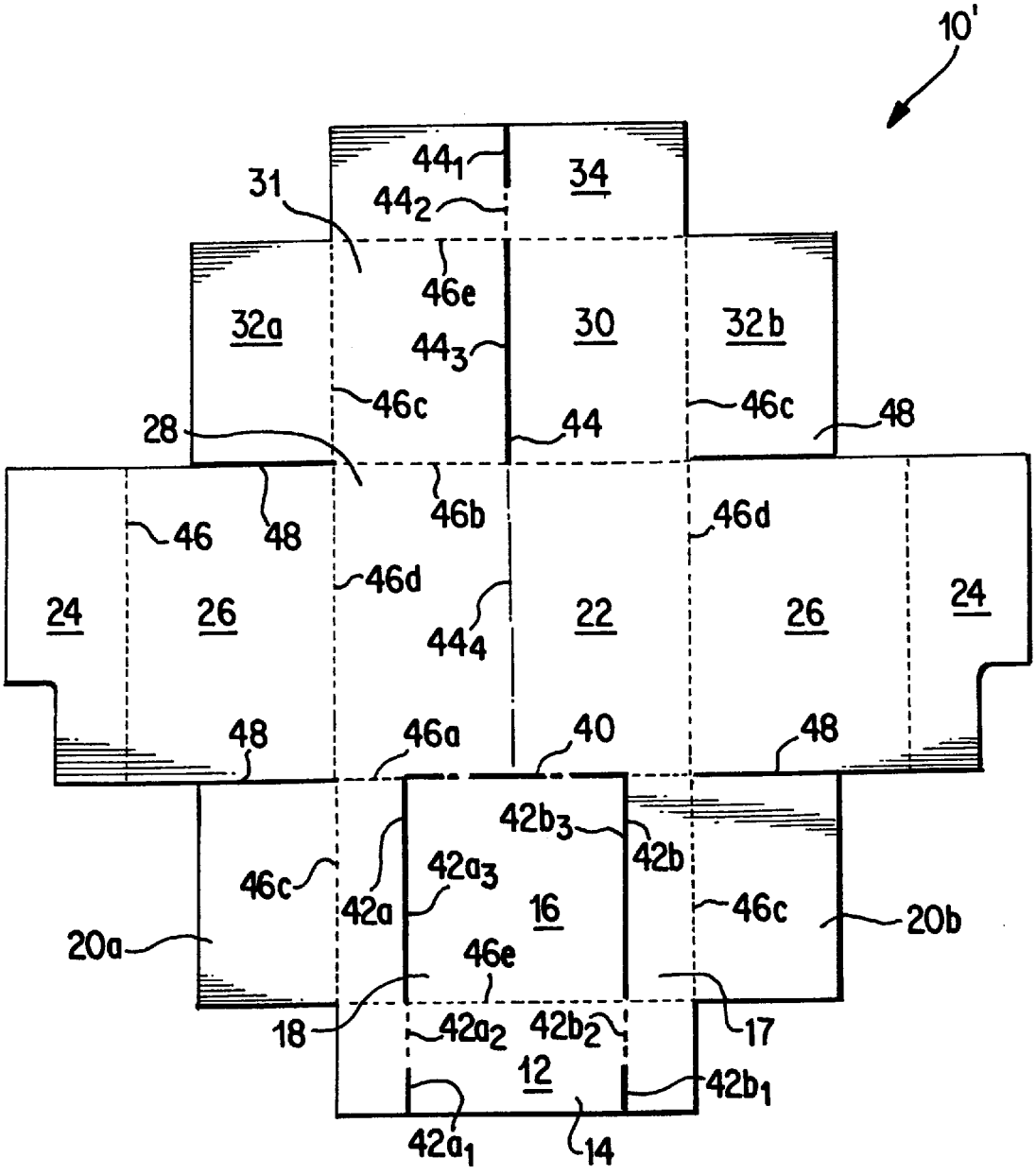
FIG. 6 is a plan view of a blank according to a further embodiment for forming the carton of the present invention.

A further embodiment of a blank 10' for forming a storage and display carton in accordance with the present invention is shown in FIG. 6, with like reference numerals being used to represent like elements. As also used in FIG. 1, dot-dash lines are used to denote lines of perforations and solid lines are used to denote cuts extending through the paperboard blank. In blank 10', each line of weakening 42*a,* 42*b* preferably includes three distinct segments. As shown in FIG. 6, lines of weakening 42*a,* 42*b* include a first portion $42a_1$, $42b_1$ which is formed as a cut extending from the edge of front top flap 12. The cut portions $42a_1$, $42b_1$, preferably extend for a distance of approximately one inch, but any length capable of facilitating the tearing of removable portions 14, 18 would be acceptable. The second portions $42a_2$, $42b_2$ of the lines of weakening 42*a,* 42*b* define perforated lines which extend from the end of portions $42a_1$, $42b_1$ to the line of weakening 46 extending between front portion 16 and front top flap 12. Finally, the third portions $42a_3$, $42b_3$ define cuts extending entirely through the depth of front portion 16. The use of cuts rather than perforations through front portion 16 facilitates a clean removal of removable portion 18 and presents a non-ragged removal edge that will become the front presentation edge when the carton is in a display configuration, as explained in detail below. Thus, in the preferred embodiment of FIG. 6, lines 42*a,* 42*b* are defined by first portions cut entirely through the paperboard, second portions each comprising a line of perforations, and third portions which are also cut entirely through the paperboard blank.

In addition, in the preferred embodiment of FIG. 6, line of weakening 44 includes four distinct segments. As shown in FIG. 6, line of weakening 44 includes a first portion $44_1$, which is formed as a cut extending from the edge of rear top flap 34. The cut portion $44_1$ preferably extends for a distance of approximately one inch, but any length capable of facilitating the tearing of rear top flap 34 would be acceptable. The second portion $44_2$ of the line of weakening 44 defines a perforated line which extends from the end of portions $44_1$ to the line of weakening 46 extending between rear portion 30 and rear top flap 34. The third portion $44_3$ defines a cut extending entirely through the depth of rear portion 30. The use of a cut along line $44_3$, rather than perforations, increases the ease with which the as formed carton ends may be rotated to obtain the display configuration of the carton, as discussed below. Lastly, the forth portion $44_4$ of the line of weakening 44 is defined by a line of perforations.

The types of perforations used for forming the various lines of perforation may differ depending upon the desired tear characteristics, the material used to form the blank, and the weight of the contents to be disposed within the formed containers. For example, line 40 extending between front portion 16 and center portion 22 is preferably formed with ¼" cuts and ⅛" spaces in order to facilitate the easy tearing of removable portions 14, 18 from the carton. On the other hand, line $44_4$ extending through center portion 22 is preferably formed with ⅛" cuts and ⅛" spaces in order to obtain a cleaner, less ragged tear. In addition, $42a_2$, $42b_2$ and $44_2$ are preferably formed with ¼" cuts and ¼" spaces. These preferred types of perforations are only examples of perforated lines which may be used and it should be apparent to one skilled in the art that any type of perforation or weakening capable of achieving a tearing therealong could also be used in the present invention.

Figure 2:
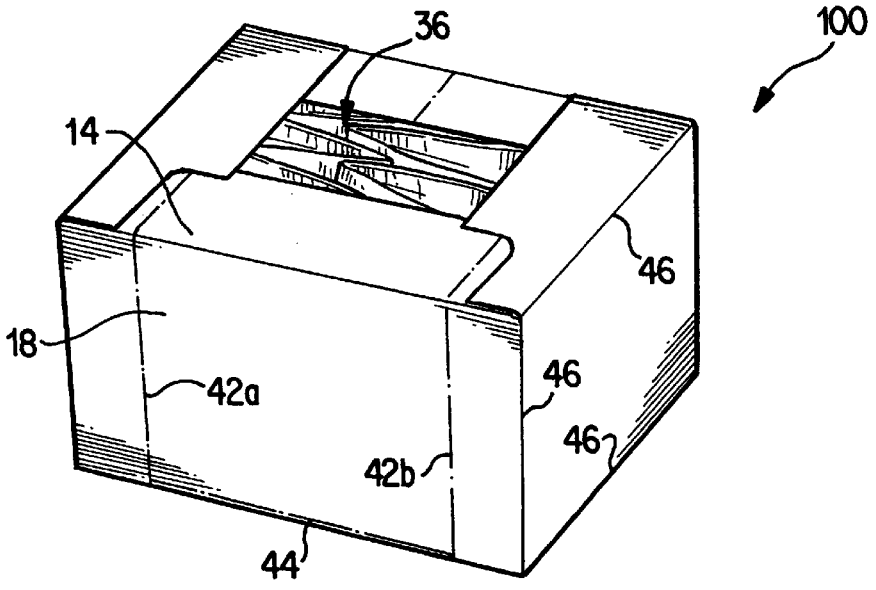
FIG. 2 is a front perspective view of a sealed carton of the present invention loaded with plurality of product packages in a storage position.
Figure 3:
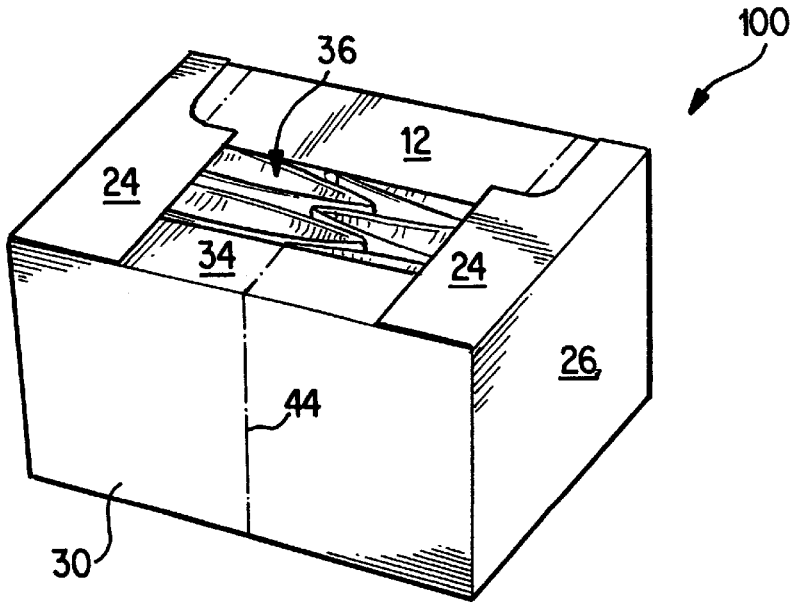
FIG. 3 is a rear perspective view of the sealed carton of FIG. 2.

Referring also to FIGS. 2 and 3, blank 10, 10' is folded along the lines of weakening 46 to form a completed carton 100, as shown in a storage configuration after being loaded with a packaged product "P" and sealed. In order to form carton 100, front portion 16 and rear portion 30 are folded upwards along lines 46*a,* 46*b,* respectively, to a position perpendicular to center portion 22. Foldable side flaps 20*a,* 20*b* and foldable side flaps 32*a,* 32*b* are then folded inward along lines 46*c* such that the free ends of flaps 20*a,* 32*a* are facing another and the free ends of flaps 20*b,* 32*b* are facing one another, bearing in mind that the side flaps are cut along solid lines 48 during the manufacture of blank 10, 10' and are not connected to end panels 26. End panels 26 can then be folded upwards along lines 46*d* and sealed to the inner side flaps to form an open carton 100.

Packaged products are loaded into carton 100, preferably in an interleaved position, as shown. Although it should be apparent to one skilled in the art that the use of carton 100 of the present invention will be advantageous for various types and sizes of packaged products, carton 100 is particularly well suited for use with packaged products having a generally triangular shape from top to bottom when in the upright position and viewed in side elevation. Such packages are generally formed as resealable pouches from a flexible film material or film and have a stand-up bottom surface, tapering sides, and are vacuum sealed. When viewed in front elevation, these packages are typically generally rectangular. These types of packages are commonly used for packaging pet food treats, microwavable items, salad croutons, fruit juices, other liquids and the like. Since these types of generally triangularly shaped packages are filled while in the upright position, the product within the package will tend to accumulate in the bottom of the package adjacent the bottom surface, thus making the lower portion of the package thicker. Because of the uneven cross-section of the packages, a plurality of packages may be loaded in two rows in an interleaved or nested orientation, top to top, thereby maximizing the storage capability of carton 100. The packages "P" in each row are loaded into the formed carton 100 on edge, in a sideways position, with the front face of the packages facing front panel 17, the stand-up bottoms of the packages being adjacent to one of the end panels 26. After loading of the packages, the front top flap 12 and rear top flap 34 are folded toward one another along lines of weakening 46*e.* Lastly, top cut out flaps 24 are folded toward one another along lines 46*f* and sealed to the front and rear flaps 12, 34, thereby sealing carton 100 for storage and shipping. The above-described sequence of folding should in no way limit the As shown in FIGS. 2 and 3, the facing edges of the top front flap 12 and the rear top flap 34 do not meet. More particularly, a width of the carton 100 is defined by the width of bottom panel member 28 as folded along line 46*a* and a depth of the carton 100 is defined by the depth of bottom panel member 28 as folded along line 46*d*. The depth of front top flap 12 is defined by the length of perforated lines 42*a*, 42*b* extending therethrough and the depth of rear top flap 34 is defined by the length of perforated line 44 extending therethrough. As thus defined, the combined depth of the front top flap 12 and the rear top flap 34 should be less than the depth of the carton. Thus, a gap 36 is defined between the facing edges of the front top flap and the rear top flap to allow the retailer to visually inspect the contents of the carton 100, even in the sealed storage configuration.

Figure 4:
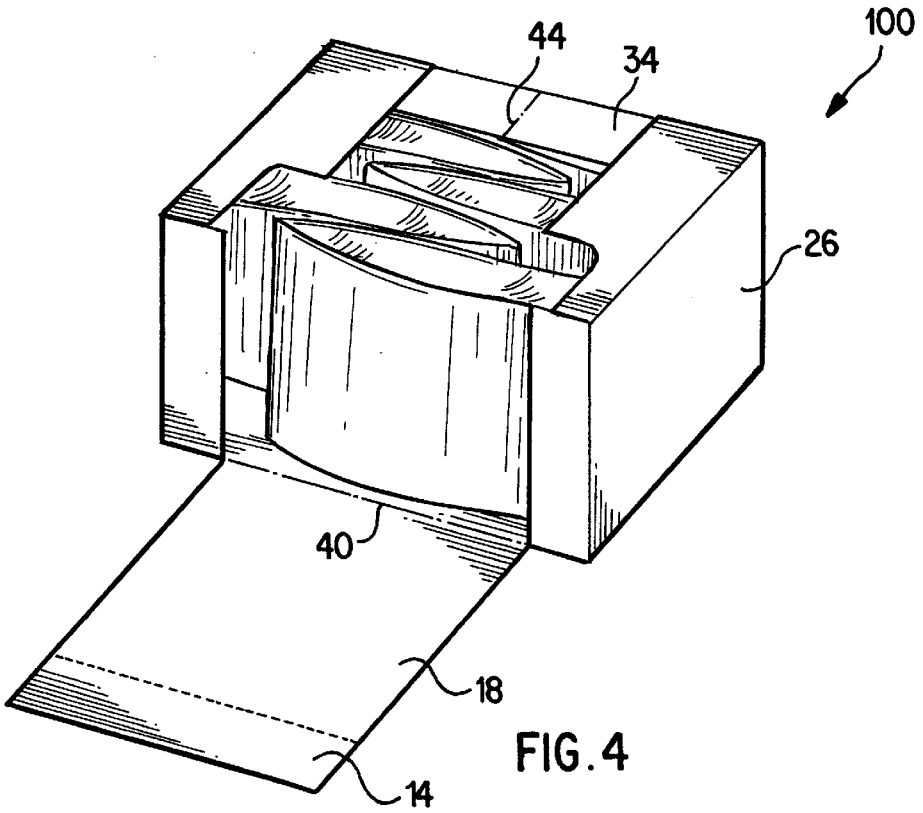
FIG. 4 is a front perspective view of the sealed carton of FIG. 2 with the removable front panel partially removed.
Figure 5:
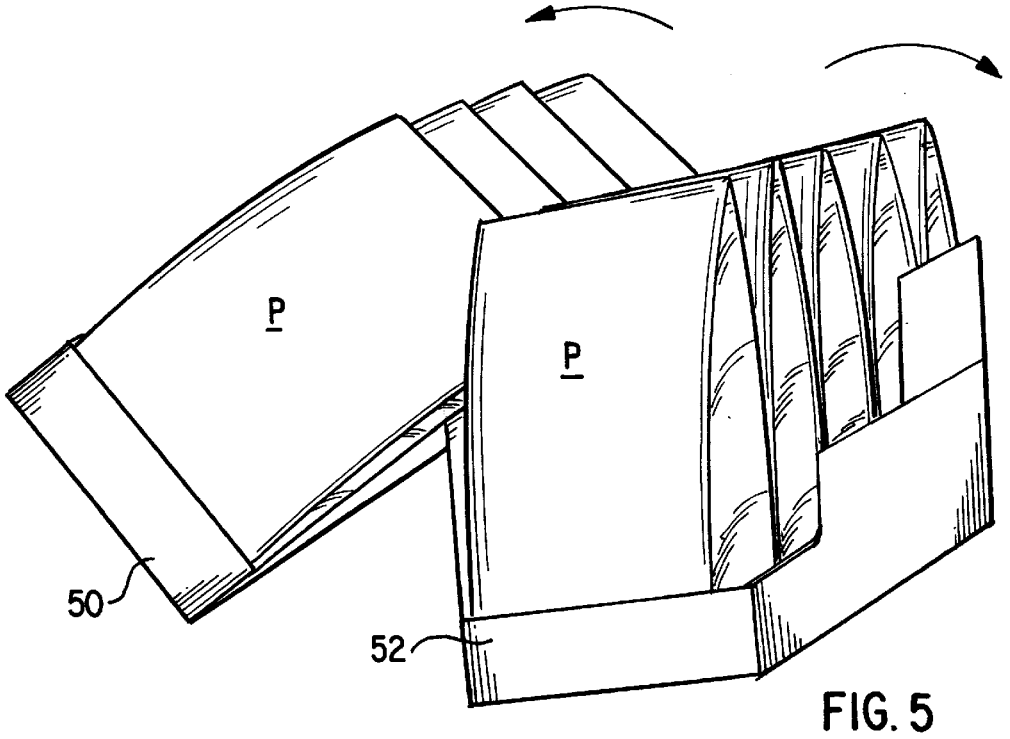
FIG. 5 is a schematic illustration of the carton of FIG. 2 with the removable front panel completely removed showing the rotation of the carton to a display position.

Referring to FIG. 4, the transformation of the carton 100 from the storage configuration shown in FIG. 2 to a display configuration is obtained through a few simple steps. Front top flap 12 is torn along lines of weakening 42*a*, 42*b* and pulled upwards, front panel 17 is torn along lines of weakening 42*a*, 42*b* to expose the fronts of the packaged products, and middle removable portions 14, 18 are completely removed by tearing along perforated line 40. With the middle portions 14, 18 removed, rear top flap 34 may easily be torn along the portion of line of weakening 44 extending therethrough and, while rotating the thus formed opposing two bases 50, 52 of the carton about the portion of line 44 extending through bottom panel member 28, the portion of line 44 extending through rear portion 30 will also tear, if not already cut, as shown in FIG. 5. The two rows of the packaged product are already aligned with the front surfaces thereof facing outwards for display to retail customers without needing to physically rearrange the packages from a storage container to a display shelf. Thus, with one simple rotation, carton 100 obtains a display configuration.

A further advantage of the present invention is that blank 10, 10' is a modified die cut tray container that may be cut utilizing a conventional die cutting machine. The folding of blank 10, 10' as described above may also be performed on conventional tray forming equipment, such as those manufactured by SWF Manufacturing of Sanger, California, without requiring any custom modifications. In a preferred embodiment, once formed, the cartons 100 will be packed by hand, although it is conceivable that automatic packing machines may also be utilized. After packing, conventional carton sealing equipment, also manufactured by SWF Manufacturing, may be used to seal the cartons. Thus, the manufacture, folding, and sealing of carton 100 may be accomplished on equipment already readily available in the field without requiring the purchase of new equipment dedicated specifically thereto.

While the present invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A shipping and display container comprising:

two opposing end panels in a spaced parallel relationship;

front and rear panels in a spaced parallel relationship defining opposing front and rear container surfaces, said front and rear panels being connected to said two opposing end panels to form a container periphery;

a bottom panel extending within the container periphery to define a bottom surface of the container;

a top member extending within the container periphery to define a top surface of the container, said top surface defining an opening for viewing contents of the container;

means for converting the container from a storage configuration to a display configuration, said conversion means including said top surface and said front surface having a removable portion defined by a pattern of lines of weakening, at least said top surface and said rear surface including a further line of weakening, and said bottom surface defining a fold line.

2. The container according to claim 1 wherein said fold line includes a perforated line contiguous with said further line of weakening.

3. The container according to claim 1 wherein said further line of weakening includes a continuous line extending through a portion of said top surface and said rear surface at a location approximately half way from each of said end walls, thereby dividing the container into two halves.

4. The container according to claim 3 wherein said further line of weakening includes a perforated line.

5. The container according to claim 3 wherein said further line of weakening includes a portion of cut line and a portion of a perforated line.

6. The container according to claim 1 wherein said top surface is formed by a plurality of overlapping flaps, said opening being defined by a gap between said plurality of flaps.

7. A blank for forming a shipping and display container, said blank comprising:

a center portion including a bottom panel member, two end panels, and two folding top flaps;

a rear portion adjacent to said center portion including a rear panel and a folding side flap extending from each side of said rear panel;

a rear top flap adjacent to said rear portion;

a front portion adjacent to said center portion including a front panel and a folding side flap extending from each side of the front panel;

a front top flap adjacent to said front portion;

said front top flap and said front panel having a pattern of lines of weakening defining a removable portion; and at least said rear top flap and said rear panel having a continuous line of weakening.

8. The blank according to claim 7 wherein said removable portion has a rectangular shape defined by said pattern of lines of weakening.

9. The blank according to claim 7 wherein said pattern of lines of weakening include lines of perforations and lines of cutting.

10. The blank according to claim 7 wherein said continuous line of weakening is disposed approximately half way between said end panels.

11. The blank according to claim 7 wherein said continuous line of weakening includes portions defined by perforated lines and portions defined by cutting lines.

12. The blank according to claim 7 wherein said bottom panel member includes a line of weakening disposed approximately half way between said end panels.

13. The blank according to claim 12 wherein said bottom panel member line of weakening comprises a line of perforations contiguous with said continuous line of weakening.

14. The blank according to claim 7 wherein said center portion extends between and thereby maintains said front portion and said rear portion in a spaced relation, a distance between said front portion and said rear portion defining a depth of the container, and a combined depth of said front top flap and said rear top flap being less than the container depth such that a gap remains when said blank is folded to form the container.

15. A method for transporting packages, said method comprising the steps of:

providing a blank for forming a shipping and display container, said blank comprising a center portion including a bottom panel member, two end panels, and two folding top flaps; a rear portion adjacent to said center portion including a rear panel and a folding side flap extending from each side of said rear panel; a rear top flap adjacent to said rear portion; a front portion adjacent to said center portion including a front panel and a folding side flap extending from each side of the front panel; a front top flap adjacent to said front portion; said front top flap and said front panel having a pattern of lines of weakening defining a removable portion; and at least said rear top flap and said rear panel having a continuous line of weakening;

forming an open container by folding and joining the front panel, rear panel, and end panels;

loading the open container with a plurality of packages positioned in a sideways orientation;

forming a substantially closed shipping container having an opening for viewing the orientation of the plurality of packages by folding and joining the front top flap, rear top flap and two folding top flaps;

transporting the substantially closed container to a different location;

at the different location, visually inspecting the orientation of the plurality of packages through the opening in the container and then removing the removable portion by tearing the pattern of lines of weakening;

tearing the continuous line of weakening along said rear top flap;

rotating the opposing ends of the container about a center line of the bottom panel member;

folding the bottom panel member essentially in half, thereby bringing the ends of the containers into contact with a support surface and positioning the loaded packages in an upright orientation.

* * * * *